US006352011B1

(12) United States Patent
Frühm

(10) Patent No.: US 6,352,011 B1
(45) Date of Patent: Mar. 5, 2002

(54) TWO-ENDED SCREWDRIVER BITS

(76) Inventor: Hermann Frühm, c/o 210 Tenth Avenue, New Westminster, British Columbia (CA), V3L 2B2

( * ) Notice: Subject to any disclaimer, the term of this patent is extended or adjusted under 35 U.S.C. 154(b) by 0 days.

(21) Appl. No.: 09/636,370

(22) Filed: Aug. 11, 2000

(51) Int. Cl.[7] ..... B25B 23/00
(52) U.S. Cl. ..... 81/438; 81/436
(58) Field of Search ..... 81/438, 436, 439

(56) References Cited

PUBLICATIONS

Stanley Joretech Catalogue 1999.
Suretorq Catalogue.
Sunbits Fastener Tools Catalogue.
Schraubwerkzeuge Bits and Tools 2000 Catalogue.

*Primary Examiner*—James G. Smith
*Assistant Examiner*—Hadi Shakeri
(74) *Attorney, Agent, or Firm*—Madson & Metcalf

(57) ABSTRACT

A two-ended screwdriver bit sized and configured to fit and lock in chucks that accept bits complying with American National Standards Institute specification ANSI B107.4-1982 for ¼ inch hexagonal bits. The two-ended bit has a hexagonal shank with two circumferentially-extending grooves in the screwdriver tip at each end of the shank. The length from the midpoint of each groove to the end of its adjacent screwdriver is ⅜ inches, permitting either end of the bit to be seated in a standard chuck.

15 Claims, 7 Drawing Sheets

TWO-ENDED SCREWDRIVER BITS

TECHNICAL FIELD

This invention pertains to screwdriver bits adapted to fit in the chuck of a power driver, quick release chuck or the like, and more particularly to a bit having an operative screwdriver tip on each end.

BACKGROUND

Screwdriver bits having a hexagonal shank and configured to be held in standard chucks have been known for many years. They are often referred to as "power bits." Such bits have a circumferential groove and are sized to fit in chucks with a hexagonal bore and having a ball which fits into the circumferential groove in the shank of the bit, locking and holding the bit in place in the chuck. A quick release chuck for this purpose is shown, for example, in U.S. Pat. No. 4,692,073 Martindell.

The standard for such prior art bits is specified by the American National Standards Institute in ANSI B107.4-1982, setting out the dimensions that make the bits compatible with standard chucks. The single circumferential groove in such bits typically has a flat portion mid way between two equal radiused portions. For ¼ inch bits, i.e. bits having a shank height of 0.248–0.250 inches, (measured across opposed flat sides) the flat portion of the groove is 1/16 inch wide and the distance from the adjacent flat end of the bit is 11/32 inch. The distance from the midpoint of the flat portion of the groove to the adjacent flat end of the bit is accordingly ⅜ inch. This is the standard length that permits the bit to be fully seated in the bore of the chuck with the ball of the chuck fitted against the circumferential groove of the bit.

Screwdriver bits of this type in the prior art are single-ended, i.e. having a screwdriver tip at only one end, the other end being flat and, in use, seated against the base of the bore of the chuck. A separate bit is required for each different size or type of fastener head.

It is desirable for screwdriver bits to be two-ended, with each end being adapted to fit a different size or type of fastener head, in order to halve the number of bits required in a set of tools, thus reducing cost and required storage space. Two-ended screwdriver bits are known, but not ones adapted to fit in a standard chuck of the type described above, that accepts standard bits complying with ANSI B107.4-1982.

I have invented a two-ended screwdriver bit that is compatible with standard chucks of the type that are adapted to receive a ¼ inch hexagonal bit having only a single screwdriver tip and that require a length of ⅜ inch between the end of the bit that seats in the chuck and the midpoint of the groove that receives the ball of the chuck; at the same time, my screwdriver bit has tips large enough to fit properly in fastener heads of the sizes that are commonly turned with ¼ inch hex bits. Surprisingly, the length of the essential, functional part of the screwdriver tip that is required in order to fully engage a recess in a fastener head can be made substantially shorter than in prior art screwdriver bits. Also, the end portion of the hexagonal shank of the bit, that is the portion between the circumferential groove and the end of the screwdriver that abuts the base of the chuck bore, can be made much shorter than in prior art screwdriver bits while remaining capable of providing a secure fitting of the hexagonal shank within the chuck. The combination of these two reductions in length of these components makes possible a two-ended bit having tips of a size that engage fully in the recesses of common fastener head sizes and which fits and is functionally compatible with chucks that accept standard ¼ inch hexagonal bits complying with ANSI B107.4-1982.

SUMMARY OF INVENTION

My invention provides a two-ended screwdriver bit which fits in chucks that accept ¼ inch hexagonal bits complying with ANSI B107.4-1982, such that either end of the screwdriver bit can be seated and locked in the chuck with the opposite end in the operative position for turning a fastener. The screwdriver bit has a hexagonal shank having a nominal height of ¼ inch, two circumferentially-extending grooves in the shank, one adjacent to each end and dividing the shank into a relatively long middle portion and two relatively short end portions, a screwdriver tip extending from each end of the shank, each tip having a free outer end, each of the grooves having a longitudinal midpoint, and the longitudinal distance between the outer end of each tip and the longitudinal midpoint of its adjacent circumferential groove being about ⅜ inches.

In one embodiment of the invention, the bit has screwdriver tips shaped to fit a standard Phillips cross-shaped recess of a fastener. The diameter of the tips is at least 0.08 inches.

According to a second embodiment of the invention, the screwdriver bit has tips shaped to fit a standard square-shaped recess of a fastener. The width of the tips between opposite faces thereof is at least 0.06 inches.

In a third embodiment, the screwdriver bit has tips shaped to fit a standard slot-shaped recess of a fastener. The width of the tips of such bits is at least 0.1 inches.

In a fourth embodiment, the screwdriver bit has tips shaped to fit a standard hexagonal-shaped recess of a fastener. The width of the tips between opposite faces thereof is at least 1/16th inch.

In a fifth embodiment, the screwdriver has tips shaped to fit a standard six-point star-shaped recess of a fastener. The width of the tips between opposite points of the star is at least 0.11 inches.

DESCRIPTION

Figure 1:
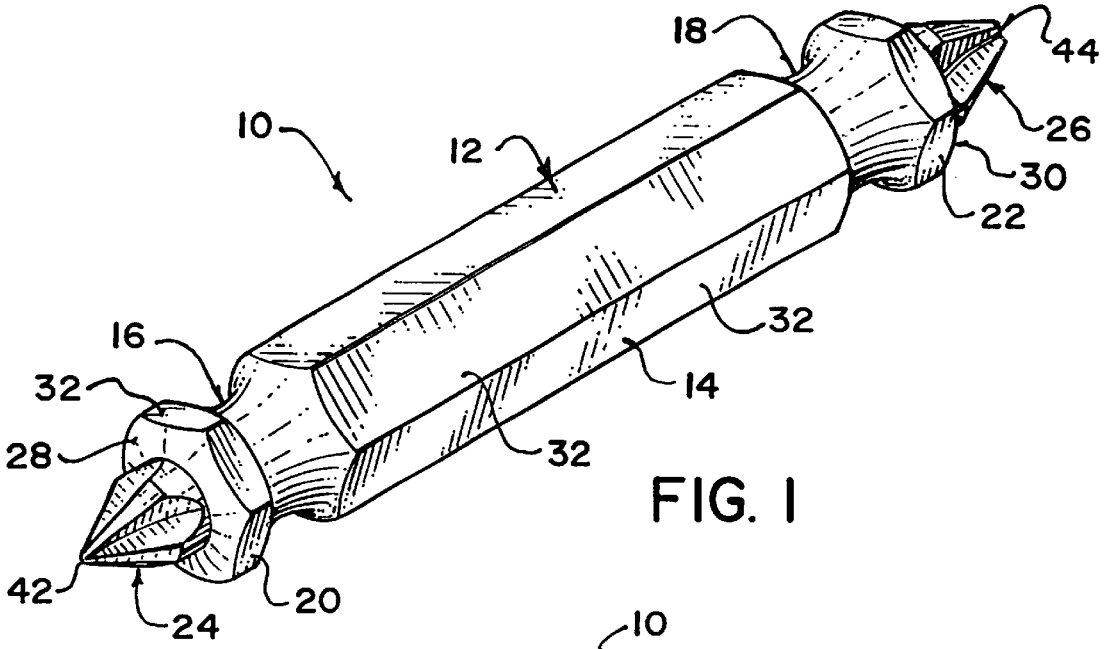
FIG. 1 is a left side perspective view of the first embodiment of a two-ended screwdriver bit according to the invention, having two Phillips-type tips.
Figure 2:
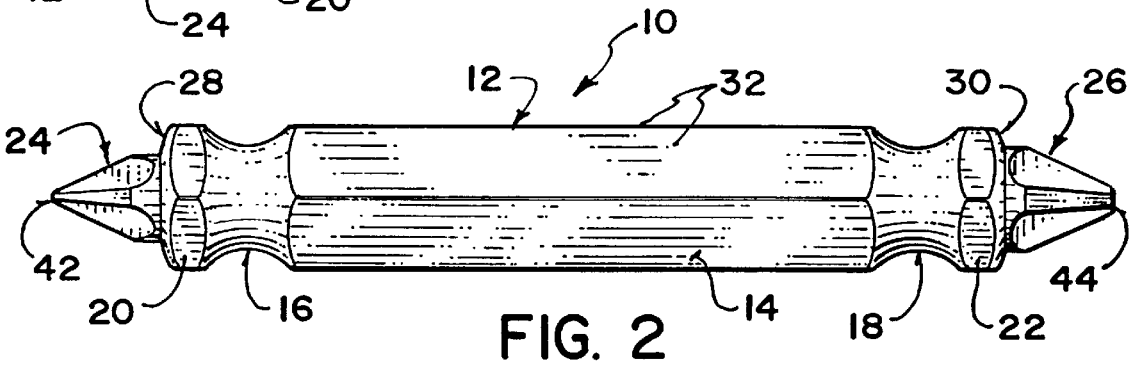
FIG. 2 is a front elevation view thereof.
Figure 3:
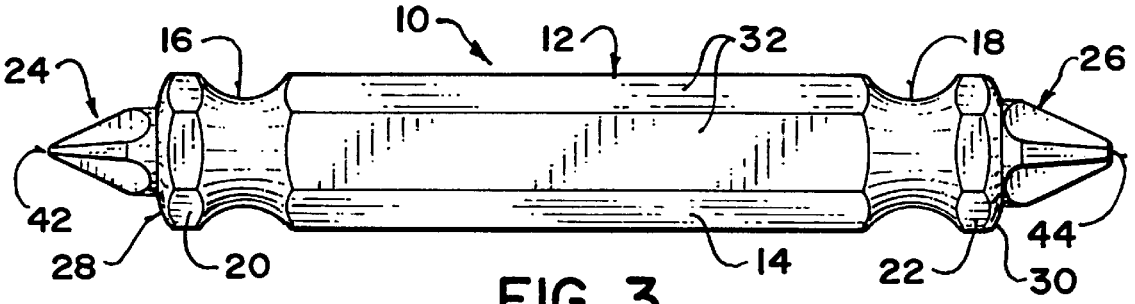
FIG. 3 is a top plan view thereof.

Screwdriver bits according to the invention have tips for turning fasteners with heads of the Phillips, square, slotted, hex and star-shaped types. FIGS. 1 to 5 show the Phillips-type screwdriver bit. Bit 10 is an integrally-made tool, being milled from a single piece of hexagonal steel shaft. The bit has a hexagonal shank 12, i.e. a shank that is a regular hexagon in cross section normal to the longitudinal axis of the shank.

Shank 12 has a middle portion 14 and end portions 20 and 22. Circumferential grooves 16 and 18 separate the middle portion 14 from the end portions 20 and 22 respectively. Middle portion 14 is substantially longer than end portions 20, 22.

Phillips-type screwdriver tips 24 and 26, configured to fit the recesses in standard Phillips-type fasteners, extend from the longitudinally outer ends 28, 30 of the end portions 20 and 22 respectively of the shank 12.

Figure 4:
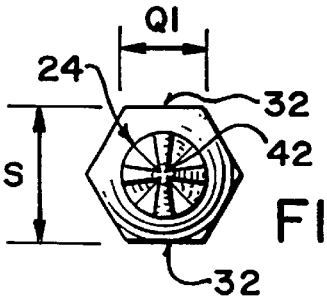
FIG. 4 is a left end elevational view thereof.

The height of shank 12, meaning the height S as shown in FIG. 4 measured across opposite flat sides 32 of the shank, is about ¼ inch, or, more precisely, a maximum of about 0.250 inches and a minimum of about 0.248 inches, in order to fit a standard ¼ inch hexagonal chuck.

Figure 6:
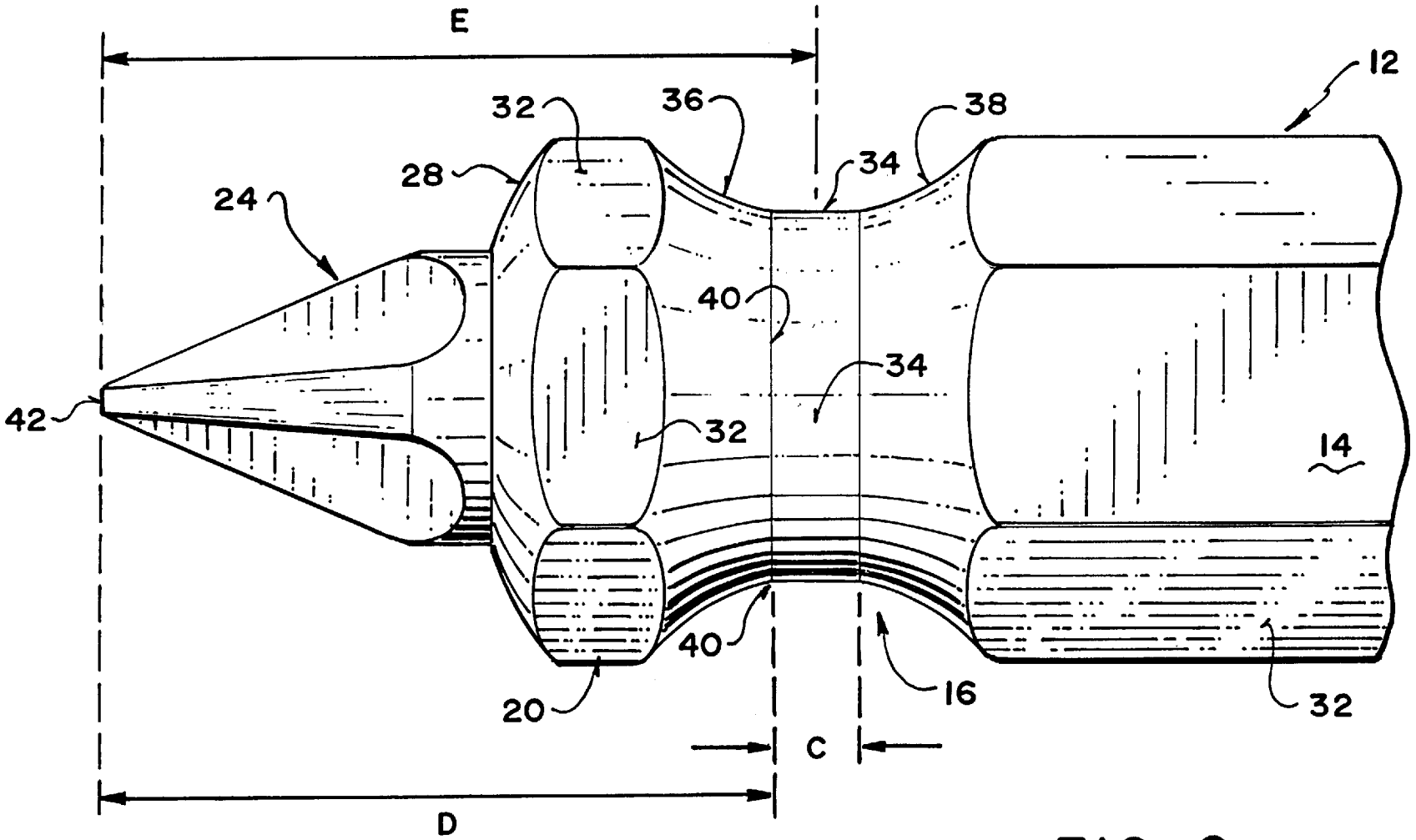
FIG. 6 is an enlarged view of one end of the screwdriver bit of FIG. 1.

The screwdriver bit 10 is intended and adapted to be held in a chuck of the type having a ball which is received in a groove of the bit in order to hold the bit in the chuck. Referring to FIG. 6, groove 16 has a flat middle portion 34 between two equal radius portions 36, 38. The width of flat portion 34, indicated by C in FIG. 6, is about 1/16 inch. The length from the junction 40 between flat portion 34 and radius portion 36 to the end 42 of screwdriver tip 24 is about 11/32 inch, indicated by D in FIG. 6, so the distance from the longitudinal midpoint of flat portion 34 (and thus the midpoint of groove 16) to the end 42 adjacent to groove 16 is about ⅜ inch, indicated by E in FIG. 6. These dimensions are equal to the corresponding dimensions on the single-ended screwdriver bit specified in ANSI B107.4-1982 for a threaded fastener drive with a ¼ inch hexagonal shank, permitting the two-ended screwdriver bit of the present invention to fit in a chuck which receives a single-ended bit conforming to said ANSI standard.

The opposite end of bit 10, with screwdriver tip 26, has the same configuration as that described above, groove 18 having the same configuration as groove 16, and the distance between the midpoint of groove 18 to end 44 of tip 26 being about ⅜ inch.

It will be understood that these ⅜ inch lengths are subject to the conventional tolerances that permit ¼ inch hex bits to fit into standard chucks; that is, the lengths can vary slightly, within conventional tolerances, and the bit will still fit and lock within a standard socket adapted to receive single-ended bits complying with ANSI B107.4-1982.

Figure 7:
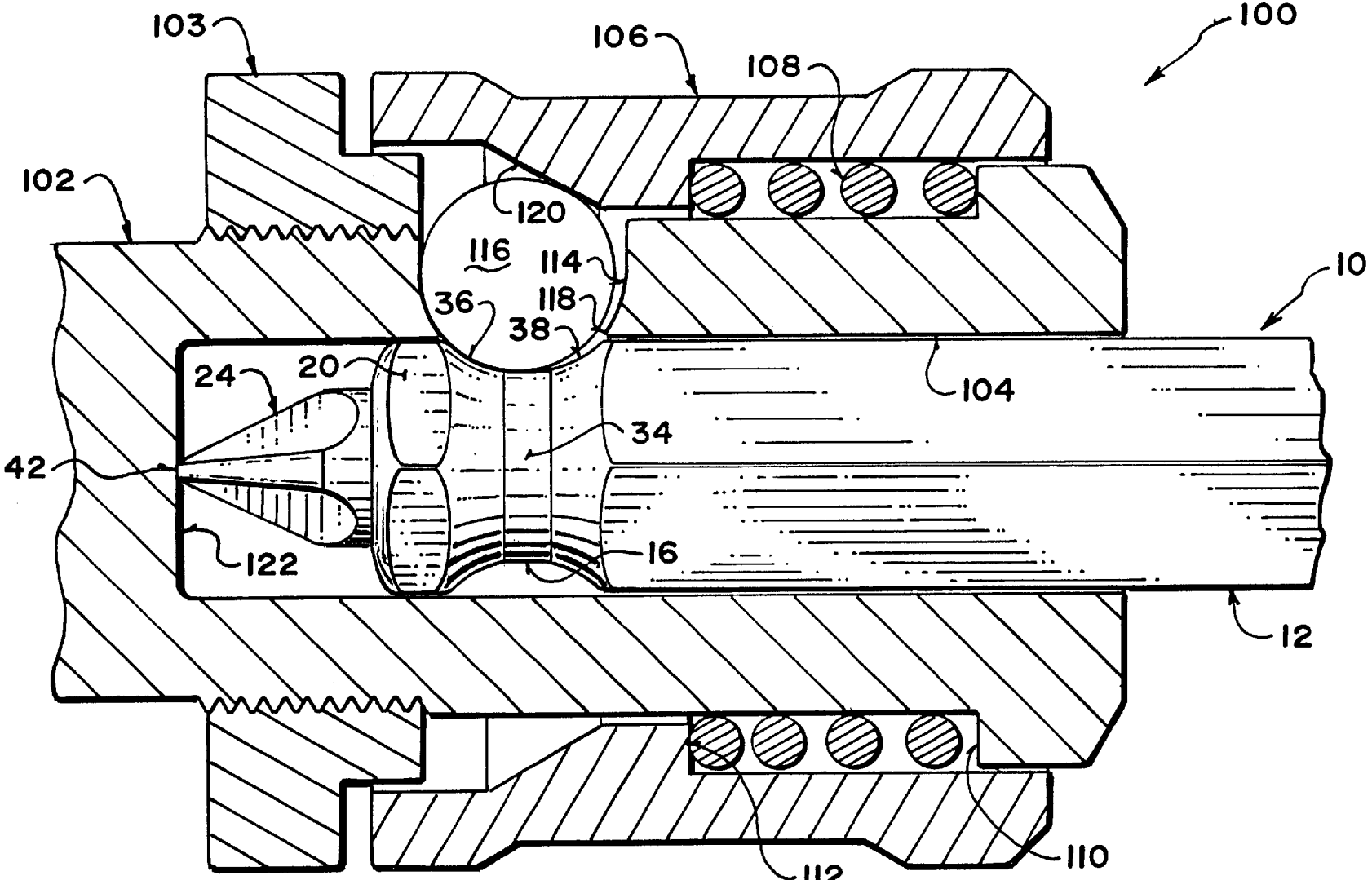
FIG. 7 is a view in partial section of the screwdriver bit of FIG. 1 seated in a chuck.
Figure 8:
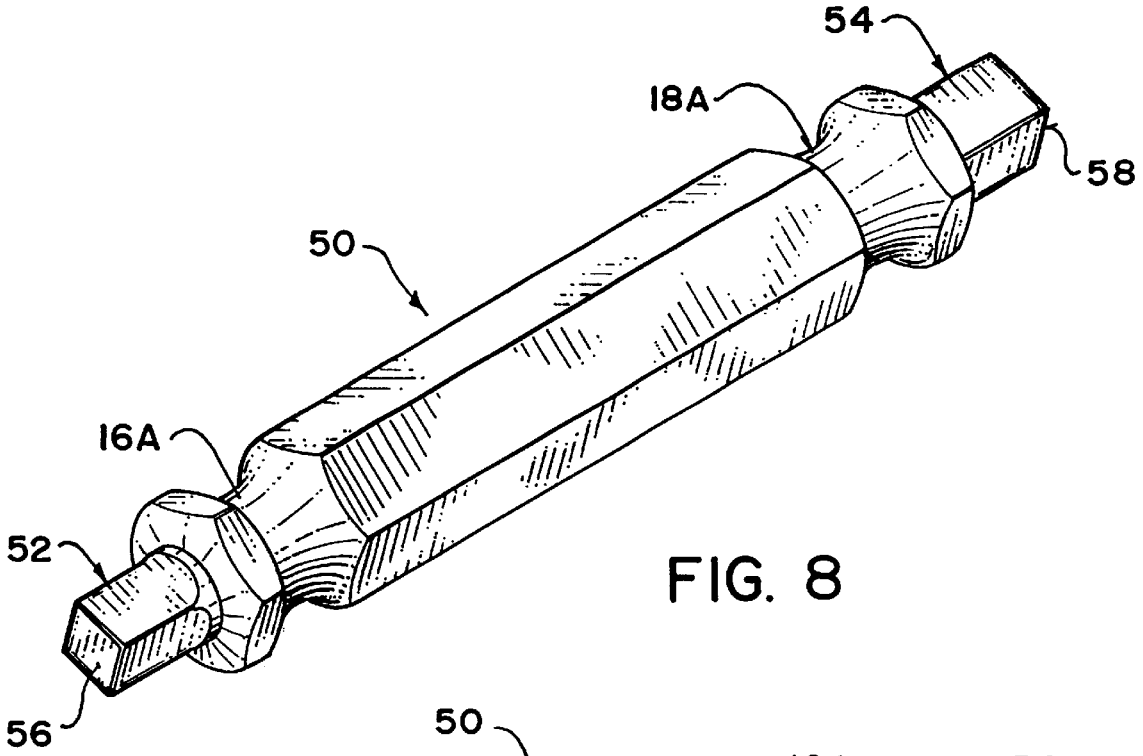
FIG. 8 is a left side perspective view of the second embodiment of a two-ended screwdriver bit according to the invention, having two square-type tips.
Figure 9:
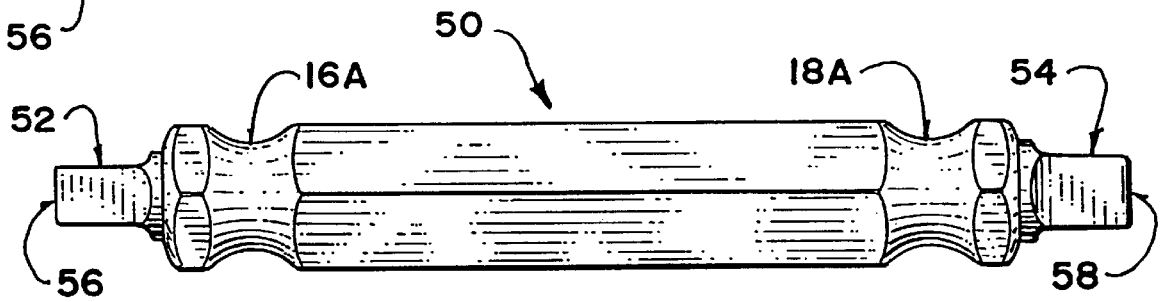
FIG. 9 is a front elevational view thereof.

FIG. 7 shows screwdriver bit 10 seated in a chuck 100 which is representative of the types of chuck that are adapted to hold and lock in place bits complying with ANSI B107.4. The chuck is part of a power driver, hand driver or similar tool. Such chucks are well known in the prior art; see, for example, U.S. Pat. No. 4,692,073 Martindell. Chuck 100 has spindle 102 with bore 104 having a hexagonal cross-section and sized to accept a ¼ inch hex shank. Spindle 102 has ring 103 threaded thereto. Movable sleeve 106 radially surrounds spindle 102. Compression spring 108, positioned between shoulder 110 of spindle 102 and shoulder 112 of sleeve 106, biases sleeve 106 rearward. Ball 116 is disposed in radially-extending bore 114 in spindle 102 and is held in place by retainer lip 118. The ball 116 extends into bore 104. Ball 116 is urged toward bore 104 by the conical bore section 120 of sleeve 106 when sleeve 106 is urged rearward by spring 108. When sleeve 106 is pulled forward by a user, compressing spring 108, ball 116 is free to move out of bore 104, releasing the bit.

When screwdriver bit 10 is seated in bore 104 of spindle 102 of the chuck 100, end 42 of screwdriver tip 24 of the bit abuts end 122 of bore 104. Ball 116 is pressed downward into bore 104 by conical bore section 120 of sleeve 106, against radius portion 36 of groove 16 of the bit, locking it in place in bore 104. The bit can be removed by moving sleeve 106 forward, permitting ball 116 to rise out of groove 16 and bore 104 when bit 10 is pulled toward the open end of bore 104.

It will be apparent that the opposite end of screwdriver bit 10 can be held in chuck 100 in the same manner, with end 44 of screwdriver tip 26 abutting end 122 of bore 104, and ball 116 fitted in groove 18.

Figure 5:
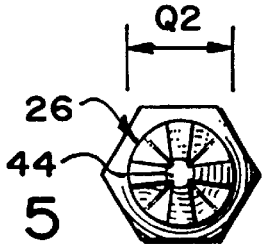
FIG. 5 is right end elevational view thereof.

The screwdriver tips 24, 26 are different sizes, so a single bit 10 can be used for fasteners with two different sizes of recess. Both tips are large enough to be used with the common sizes of fastener that are turned with a ¼ inch hex bit, in particular Phillips No. 0, 1, 2 or 3. The diameter Q1 of tip 24 and diameter Q2 of tip 26, as shown in FIGS. 4 and 5, measured adjacent the ends 28, 30 respectively of the shank, is accordingly at least 0.08 inches, which is the typical diameter of the tip of a Phillips No. 0 bit.

FIGS. 8–11 show a second embodiment of the invention in which the screwdriver tips are the square-drive type. Screwdriver bit 50 has the same structure as described above for the Phillips-type bit, with a ¼ inch hexagonal shank, except that the tips 52, 54 have a square cross section, as viewed normal to the longitudinal axis of the tip, being adapted to fit conventional square fastener head recesses. The length from the longitudinal midpoint of grooves 16A, 18A (which correspond to grooves 16, 18 in the embodiment of FIG. 1) to ends 56, 58 respectively, is about ⅜ inch, permitting bit 50 to fit into a standard chuck, as described above for the embodiment of FIG. 1.

Figure 10:
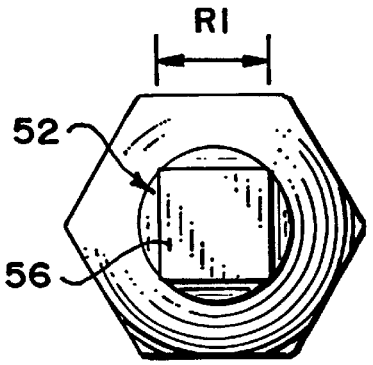
FIG. 10 is an enlarged left end elevational view thereof.
Figure 11:
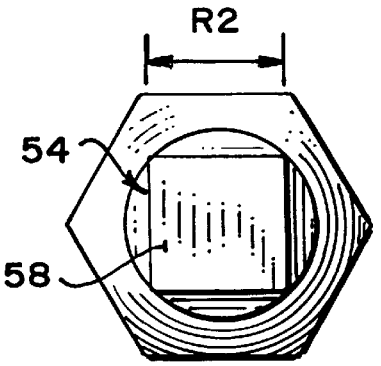
FIG. 11 is an enlarged right end elevational view thereof.
Figure 12:
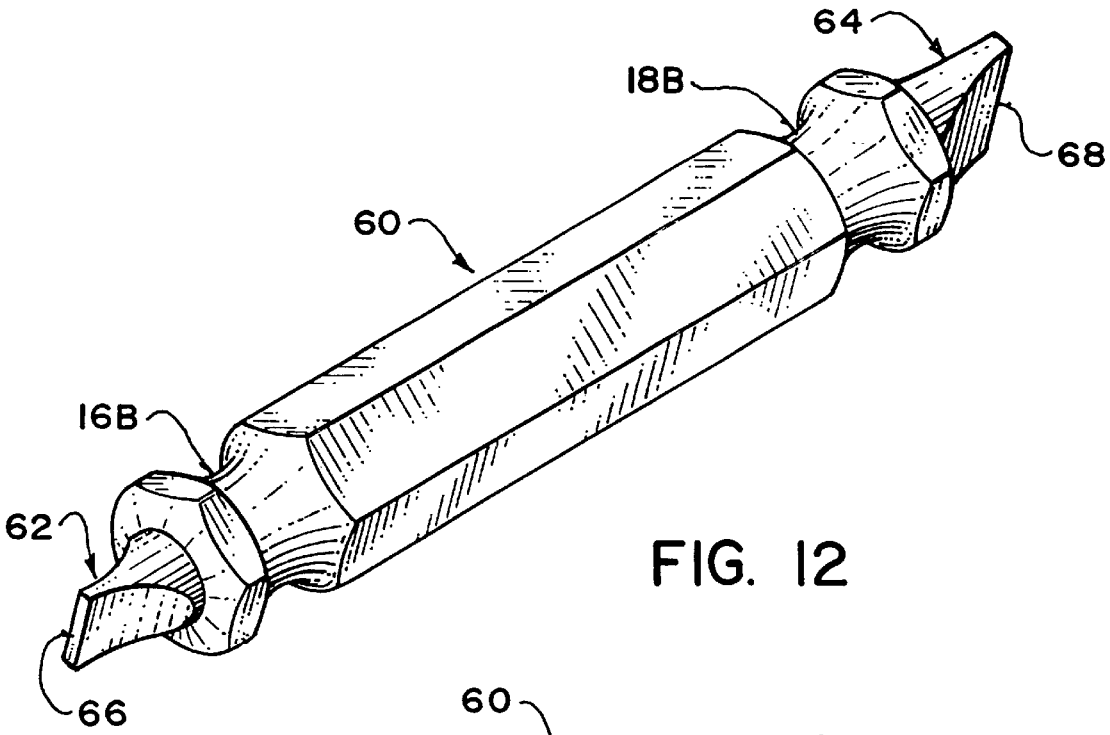
FIG. 12 is a left side perspective view of the third embodiment of a two-ended screwdriver bit according to the invention, having two slot-type tips.
Figure 13:
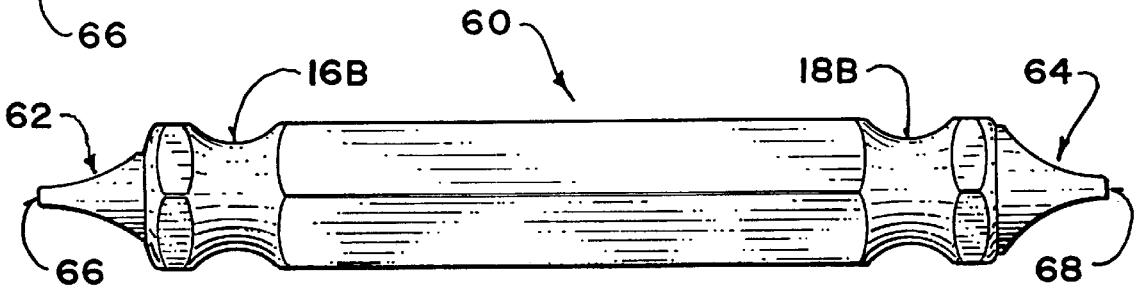
FIG. 13 is a front elevational view thereof.

The screwdriver tips 52, 54 are different sizes, so a single bit 50 can be used for fasteners with two different sizes of recess. Both tips are large enough to be used with the common sizes of fastener that are turned with ¼ inch hex bits, in particular sizes No. 0, 1, 2 and 3. The widths R1 of tip 52 and R2 of tips 54, 58, as measured between opposed longitudinal faces of the tips as shown in FIGS. 10 and 11, are accordingly at least 0.06 inches, which is the typical diameter of the tip of a square No. 0 size bit.

FIGS. 12–15 show a third embodiment of the invention in which the screwdriver tips are the slotted-drive type. Screwdriver bit 60 has the same structure as described above for the Phillips-type bit, with a ¼ inch hexagonal shank, except that the tips 62, 64 have a rectangular cross section, as viewed normal to the longitudinal axis of the tip, being adapted to fit conventional slotted fastener head recesses. The length from the longitudinal midpoint of grooves 16B, 18B (which correspond to groove 16, 18 in the embodiment of FIG. 1) to ends 66, 68 respectively, is about ⅜ inch, permitting bit 60 to fit into a standard chuck, as described above for the embodiment of FIG. 1.

Figure 14:
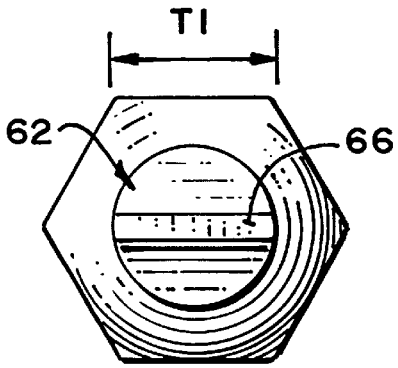
FIG. 14 is an enlarged left end elevational view thereof.
Figure 15:
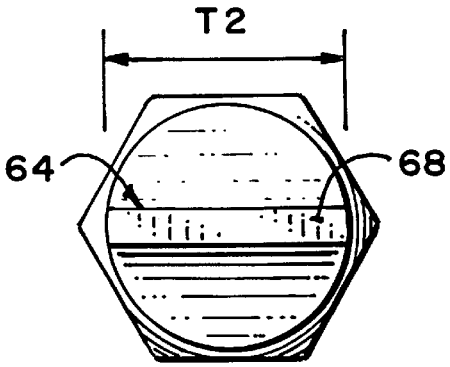
FIG. 15 is an enlarged right end elevational view thereof.
Figure 16:
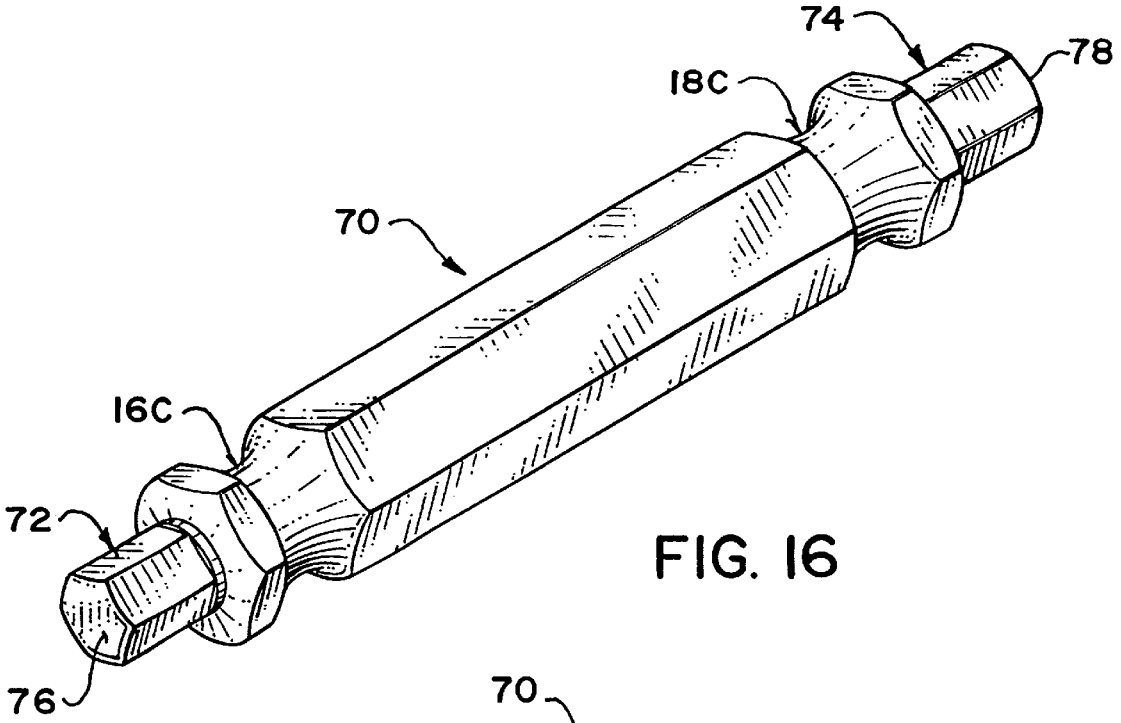
FIG. 16 is a left side perspective view of the fourth embodiment of a two-ended screwdriver bit according to the invention, having two hex-type tips.
Figure 17:
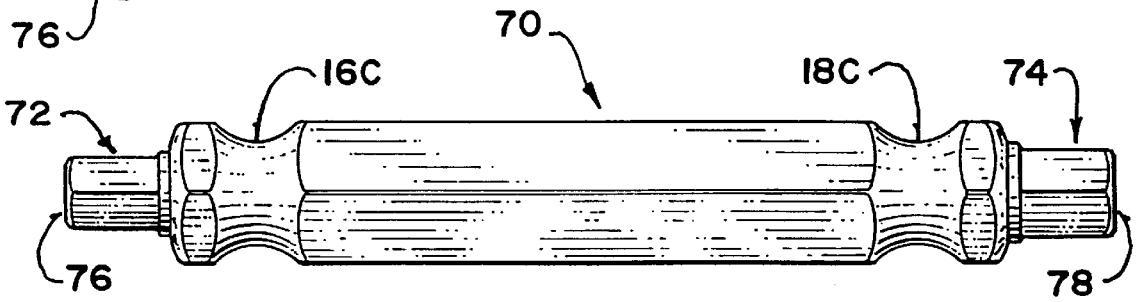
FIG. 17 is a front elevational view thereof.

The screwdriver tips 62, 64 are different sizes, so a single bit 60 can be used for fasteners with two different sizes of recess. Both tips are large enough to be used with the common sizes of fastener that are turned with ¼ inch hex bits, in particular sizes No. 0–8. The widths T1 of tip 62 and T2 of tip 64, at ends 66, 68 respectively thereof, as shown in FIGS. 14 and 15, are accordingly at least 0.1 inches, which is the typical width for a slotted No. 0 bit.

FIGS. 16–19 show a fourth embodiment of the invention in which the screwdriver tips are the hexagonal-drive type. Screwdriver bit 70 has the same structure as described above for the Phillips-type bit, with a ¼ inch hexagonal shaft, except that the tips 72, 74 have a hexagonal cross section, as viewed normal to the longitudinal axis of the tip, being adapted to fit conventional hexagonal fastener head recesses. The length from the longitudinal midpoint of grooves 16C, 18C (which correspond to grooves 16, 18 in the embodiment of FIG. 1, to ends 76, 78 respectively, is about ⅜ inch, permitting bit 70 to fit into a standard chuck as described above for the embodiment of FIG. 1.

Figure 18:
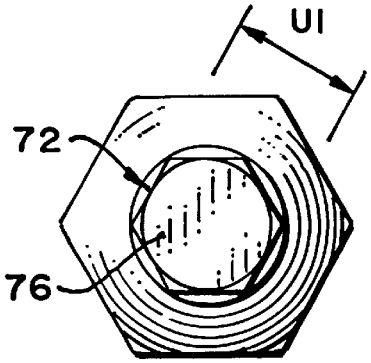
FIG. 18 is an enlarged left end elevational view thereof.
Figure 19:
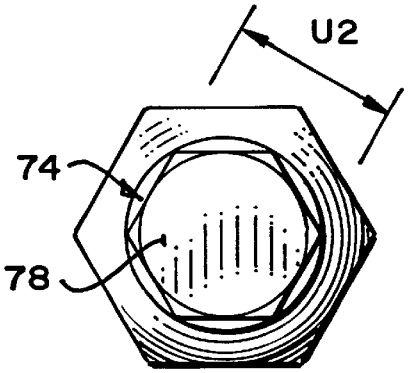
FIG. 19 is an enlarged right end elevational view thereof.
Figure 20:
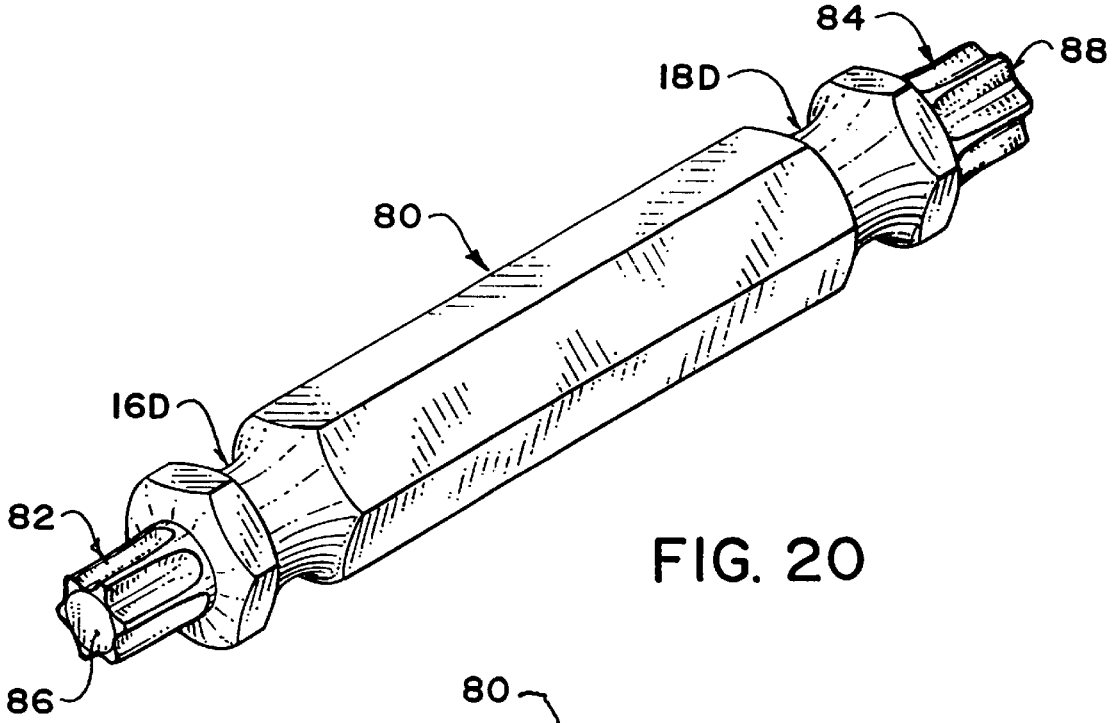
FIG. 20 is a left side perspective view of the fifth embodiment of a two-ended screwdriver bit according to the invention, having two star-type tips.
Figure 21:
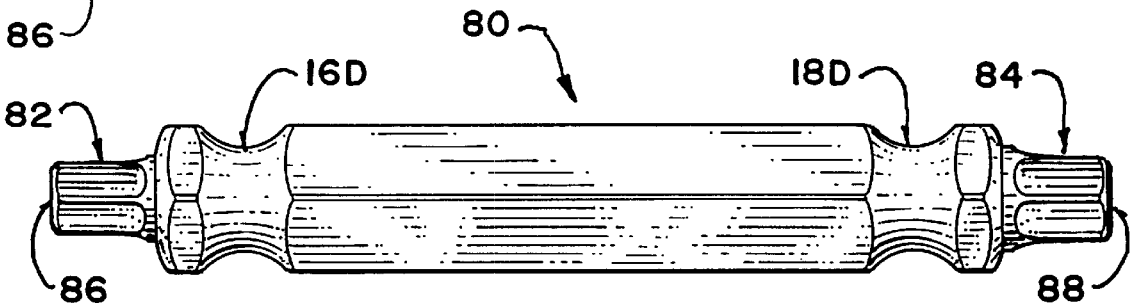
FIG. 21 is a front elevational view thereof.

The screwdriver tips 72, 74 are different sizes, so a single bit 70 can be used for fasteners with two different sizes of recess. Both tips are large enough to be used with the common sizes of fastener that are turned with ¼ inch hex bits, in particular fasteners having a 1/16 to ¼ inch diameter recess in the fastener head. The widths U1 of tip 72 and U2 of tip 74, as shown in FIGS. 18 and 19 and measured across opposed flat sides of the hexagonal tip, are accordingly at least 1/16 inches.

FIGS. 20–23 show a fifth embodiment of the invention in which the screwdriver tips are the star-drive type. Screwdriver bit 80 has the same structure as described above for the Phillips-type tips, with a ¼ inch hexagonal shank, except that the tips 82, 84 have a star-shaped cross section, with six points, as viewed normal to the longitudinal axis of the tip, being adapted to fit conventional star-shaped fastener head recesses. The length from the longitudinal midpoint of grooves 16D, 18D (which correspond to grooves 16, 18 in the embodiment of FIG. 1, to ends 86, 88 respectively, is about ⅜ inch, permitting bit 80 to fit into a standard chuck, as described above for the embodiment of FIG. 1.

Figure 22:
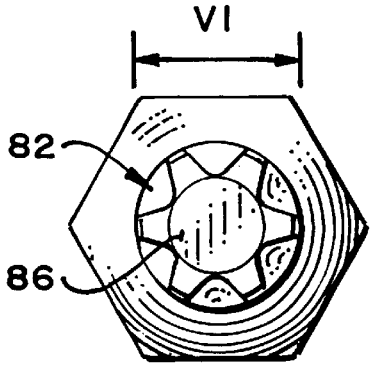
FIG. 22 is an enlarged left end elevational view thereof.
Figure 23:
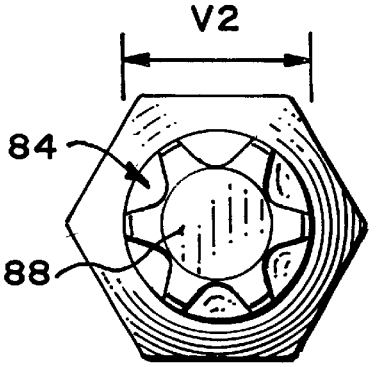
FIG. 23 is an enlarged right end elevational view thereof.

The screwdriver tips 82, 84 are different sizes, so a single bit 80 can be used for fasteners with two different sizes of recess. Both tips are large enough to be used with the common sizes of fastener that are turned with ¼ inch hex bits, in particular sizes TORX® No. T-10 to T-40. The widths V1 of tip 82 and V2 of tip 84, as shown in FIGS. 22 and 23, measured across the ends of opposed points of the star, is accordingly at least 0.11 inches, which is the typical width for a size No. T-10 bit.

As will be apparent to those skilled in the art in the light of the foregoing disclosure, many alterations and modifications are possible in the practice of this invention without departing from the spirit or scope thereof. For example, rather than both tips of a screwdriver bit being of the same kind, eg. both Phillips-type, one can be one kind and one a different kind, for example, one Phillips and the other square. Accordingly, the scope of the invention is to be construed in accordance with the substance defined by the following claims.

What is claimed is:

1. A two-ended screwdriver bit comprising:

(a) a hexagonal shank having two ends and having a height of about ¼ inch;

(b) two circumferentially-extending grooves in said shank, one adjacent each end of said shank and dividing said shank into a middle portion and two end portions;

(c) a screwdriver tip extending from each end of said shank, each said screwdriver tip having a free outer end;

(d) each said groove having a longitudinal midpoint; and (e) a longitudinal distance between said outer end of each said tip and said longitudinal midpoint of its adjacent circumferential groove is about ⅜ inches.

2. A bit according to claim 1 wherein at least one of said screwdriver tips is shaped to fit a standard Phillips cross-shaped recess of a fastener.

3. A bit according to claim 2 wherein a width of said at least one tip at an end thereof adjacent to said shank is 0.08 inches or larger.

4. A bit according to claim 1 wherein at least one of said screwdriver tips comprises opposed longitudinal faces shaped to fit a standard square-shaped recess of a fastener.

5. A bit according to claim 4 wherein said at least one tip has a width of 0.06 inches or larger, as measured between said opposed longitudinal faces of said tip.

6. A bit according to claim 1 wherein at least one of said screwdriver tips is shaped to fit a standard slot-shaped recess of a fastener.

7. A bit according to claim 6 wherein said at least one tip has a width of 0.1 inches or larger at said free outer end thereof.

8. A bit according to claim 1 wherein at least one of said screwdriver tips comprises opposed flat sides shaped to fit a standard hexagonal-shaped recess of a fastener.

9. A bit according to claim 8 wherein said at least one tip has a width of 1/16 inches or larger, as measured across said opposed flat sides of said tip.

10. A bit according to claim 1 wherein at least one of said screwdriver tips comprises opposed sides shaped to fit a standard six-point star-shaped recess of a fastener.

11. A bit according to claim 10 wherein said at least one tip has a width of 0.11 inches or larger, as measured across said opposed points of said tip.

12. A bit according to claim 2 wherein said fastener is a Phillips No. 0 size fastener.

13. A bit according to claim 2 wherein said fastener is a Phillips No. 1 size fastener.

14. A bit according to claim 2 wherein said fastener is a Phillips No. 2 size fastener.

15. A bit according to claim 2 wherein said fastener is a Phillips No. 3 size fastener.

* * * * *